United States Patent [19]

Bean et al.

[11] 4,164,165

[45] Aug. 14, 1979

[54] SAFETY APPARATUS FOR FIRING EQUIPMENT

[75] Inventors: Mervyn L. Bean, Darlington; Samuel Price, Barrow-in-Furness, both of England

[73] Assignee: Vickers Limited, United Kingdom

[21] Appl. No.: 823,114

[22] Filed: Aug. 9, 1977

[51] Int. Cl.[2] ..... F41D 11/02

[52] U.S. Cl. ..... 89/134; 235/307; 364/423

[58] Field of Search ..... 89/41 C, 134; 235/307; 364/423

[56] References Cited

U.S. PATENT DOCUMENTS

| | | | |
|---|---|---|---|
| 2,450,551 | 10/1948 | Harrington | 89/134 |
| 3,618,456 | 9/1969 | Mindel | 89/134 |
| 3,978,327 | 8/1976 | Huber | 340/146.1 BE |

OTHER PUBLICATIONS

NASA Tech. Brief 67-10086, pp. 1-2, Apr. 1967.

*Primary Examiner*—Stephen C. Bentley
*Attorney, Agent, or Firm*—Larson, Taylor and Hinds

[57] ABSTRACT

There is disclosed safety apparatus for firing equipment. The apparatus includes an electrically readable memory for storing a set of values which indicate directions of firing which are safe as regards where the equipment is mounted and means for providing from indications of actual direction, an inhibition of firing at such directions which are unsafe as regards where the equipment is mounted.

2 Claims, 5 Drawing Figures

SAFETY APPARATUS FOR FIRING EQUIPMENT

Figure 1:
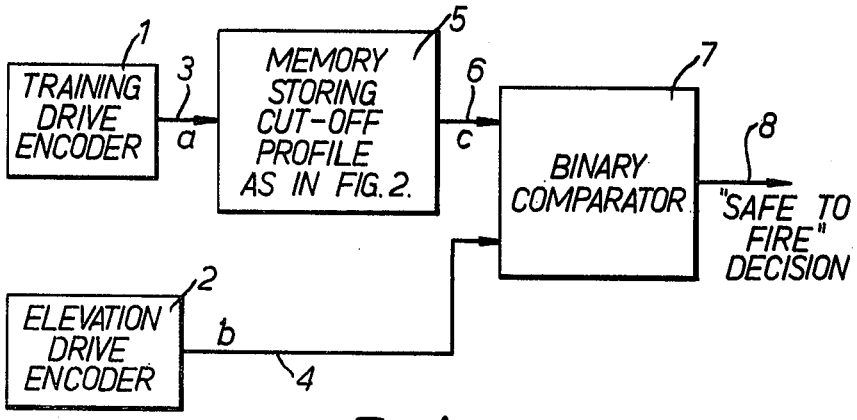

This invention relates to safety apparatus for firing equipment.

According to this invention there is provided safety apparatus for firing equipment, the apparatus including an electrically readable memory for storing a set of values which indicate directions of firing which are safe as regards where the equipment is mounted and means for providing from indications of actual direction, an inhibition of firing at such directions which are unsafe as regards where the equipment is mounted.

The invention is applicable to safety apparatus for use with firing equipment which has a trainable (i.e. rotatable about a vertical axis) and elevatable (i.e. rotatable about a horizontal axis) projectile guide, such as a gun or missile launcher etc., such as may be mounted on a ship or a land emplacement, or a land or airborne vehicle, so that the firing equipment may be inhibited from firing when such firing would cause the shell or missile or other projectile so fired or the blast from rocket efflux from that firing, if the projectile is a rocket, to strike or damage the fabric of the ship, or emplacement, or land or airborne vehicle, on which the firing equipment is mounted.

In this case, the said means could include respective angular position transducers for defining training and elevation angles of such a projectile guide (such as a gun barrel or missile launcher barrel), and comparator means, the apparatus being such that, in use, a first binary number, derived from one of the transducers, addresses the memory and a second binary number, derived from the other of the transducers, is compared by the comparator means with a third binary number, defining a minimum "safe to fire" training (or elevation) angle at the elevation (or training) angle defined by the first binary number and stored at the address in the memory located by the first binary number, to decide whether or not it is safe to fire at the particular training angle and the particular elevation angle.

Apparatus according to the invention could be in conjunction with at least one other such apparatus whereby it is in duplicated or multiplicated form to achieve a failure to safety capability and increase apparatus availability.

Fault checking circuitry could be included to verify the correct operation of apparatus according to the invention.

The memory could also be capable of storing different sets of values for use respectively with different types of projectile fired from the same projectile guide of firing equipment.

The memory could be such that the or each set of values is alterable.

This invention also comprises apparatus according to the invention in combination with firing equipment with which it is suitable for working. In such a combination, the firing equipment (such as a gun turret or missile launcher) could have a plurality of projectile guides (such as gun barrels or missile launcher barrels), the apparatus being usable with all the guides together or individually for each guide.

Figure 2:
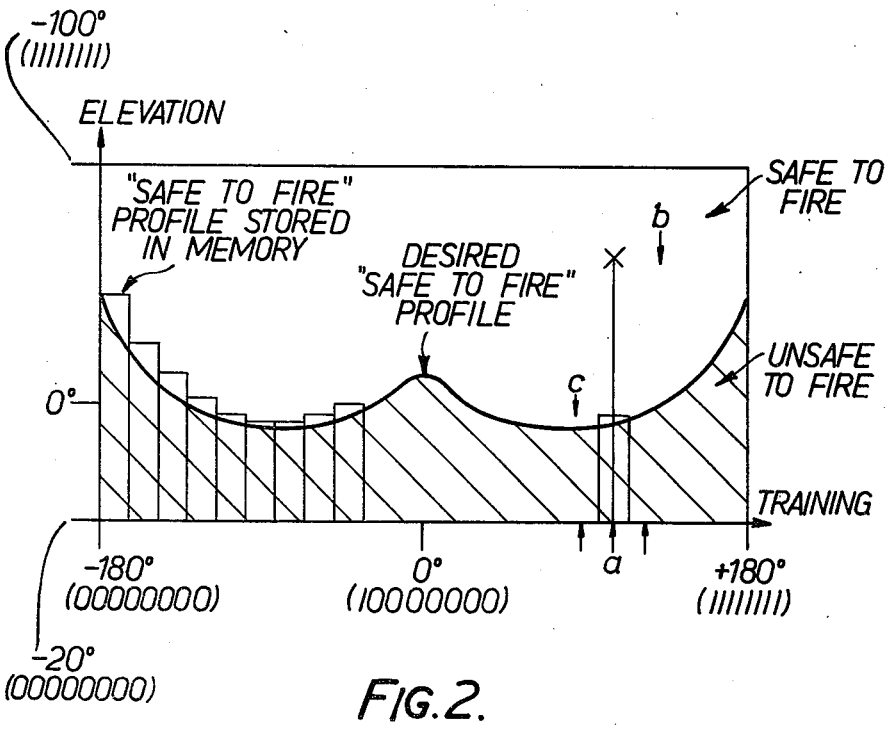
Figure 3:
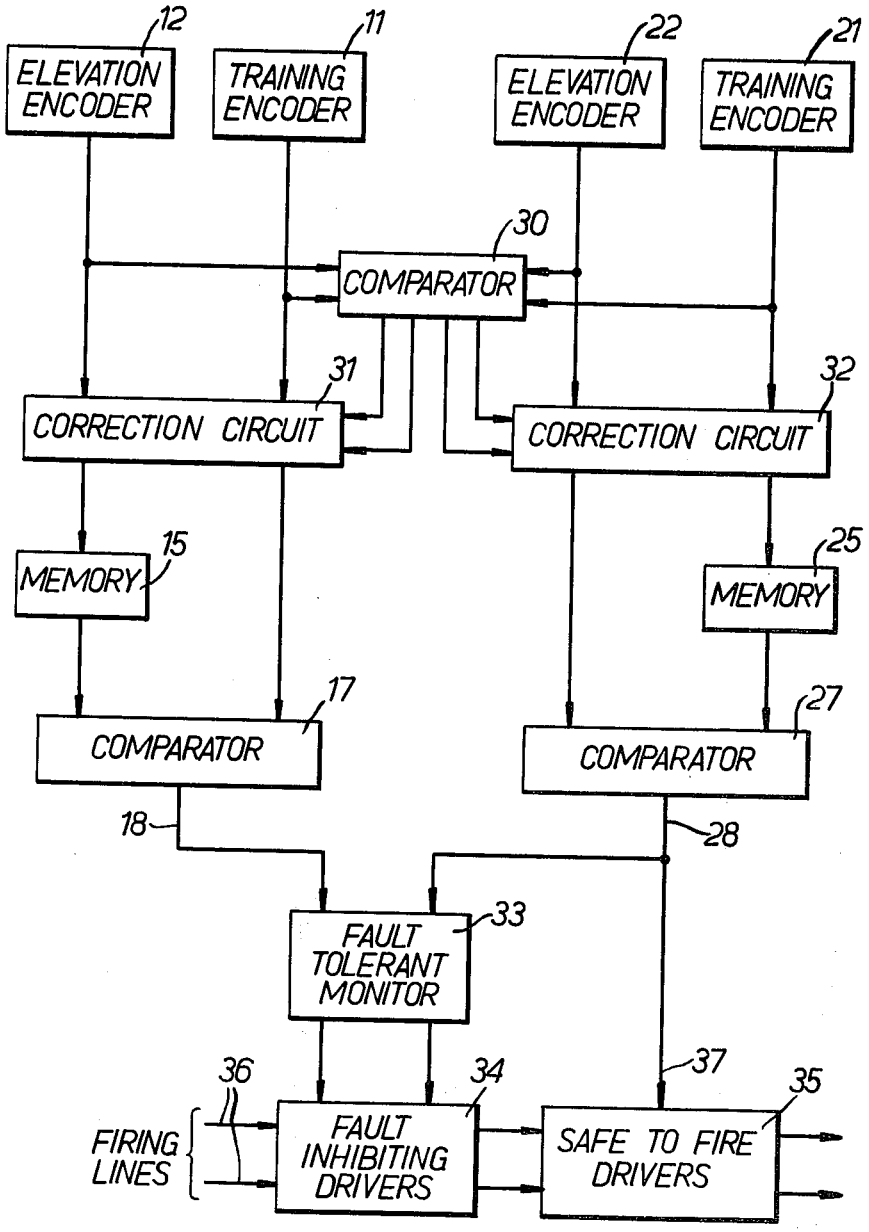
Figure 4:
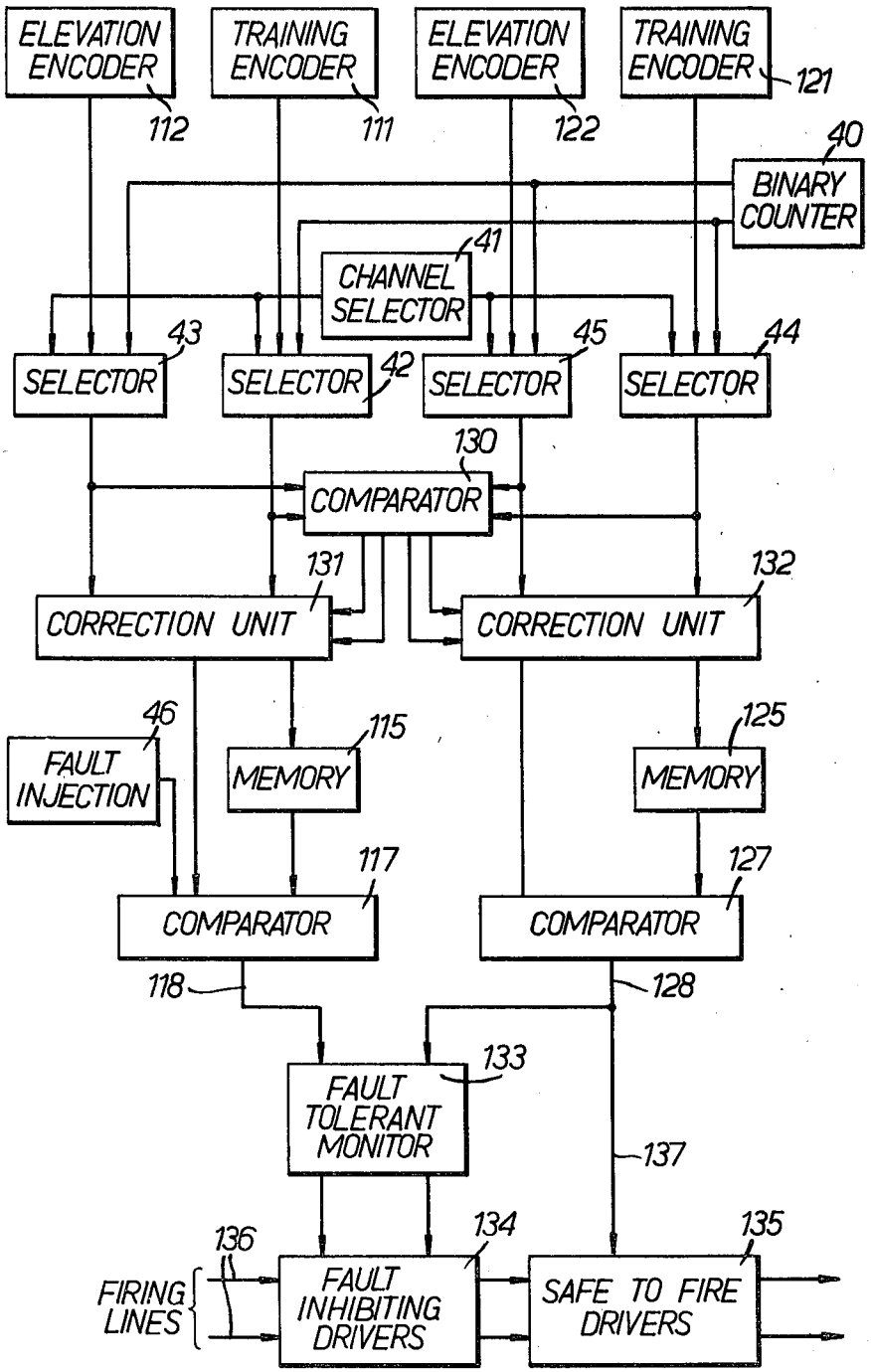
Figure 5:
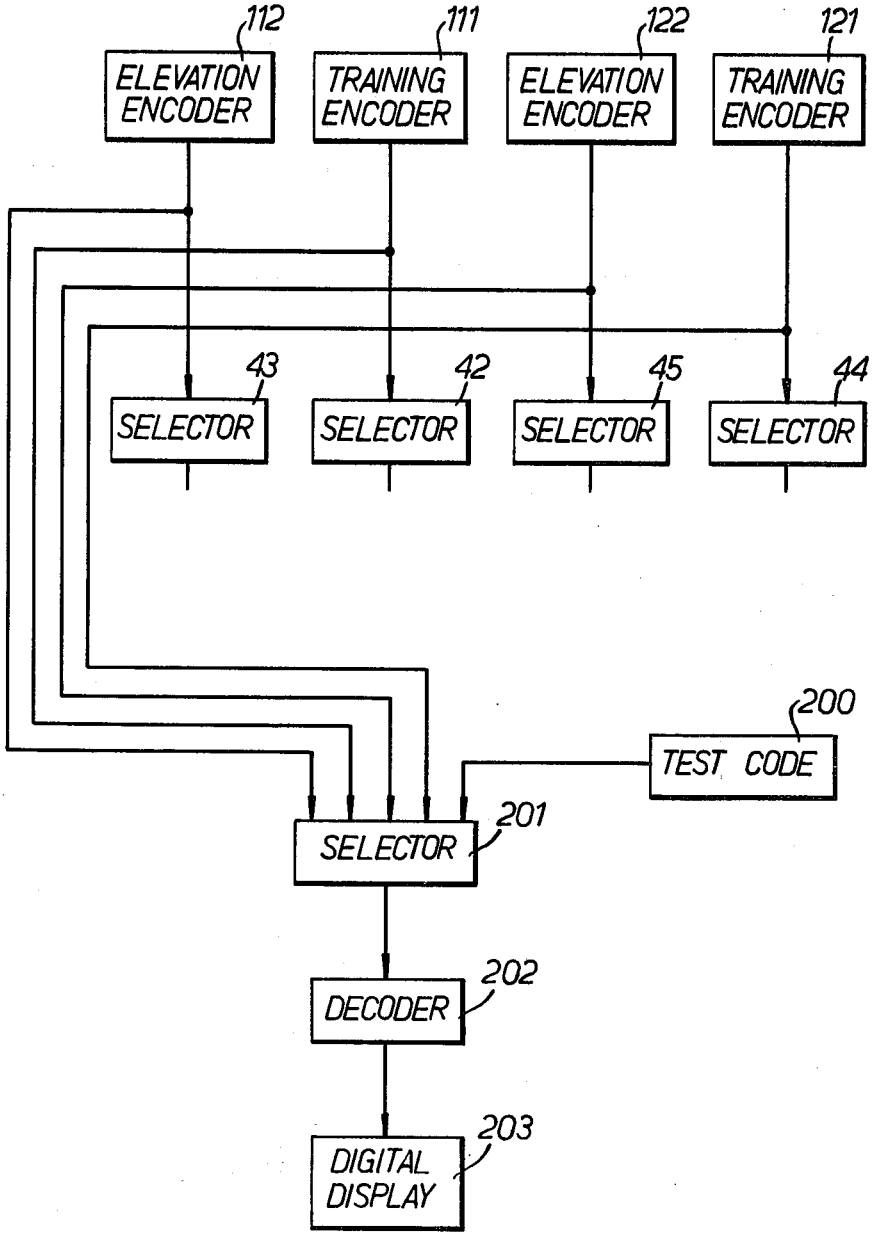

The invention will now be described, by way of example, with reference to the accompanying drawings, in which:

FIG. 1 is a block diagram showing the basic principle of a safety apparatus for projectile firing equipment, FIG. 2 shows how a set of values is stored in a memory of the apparatus, FIGS. 3 and 4 show different ways in which the apparatus could be duplicated and include further circuitry and FIG. 5 shows how an angular position display can be incorporated in the system of FIG. 4.

The apparatus to be described is intended for use with the mounting of a gun on a ship, but it could be applied equally well to any offensive or defensive weapon in the form of projectile firing equipment, such as a missile launcher, mortar, depth charge firer or laser system etc., whether mounted on a seaborne, airborne or land vehicle or in a statically based battery. The term "training" will be used to define rotation of the gun about a vertical axis and the term "elevation" will be used to define rotation of the gun about a horizontal axis.

In FIG. 1, two encoders 1 and 2 (or similar devices) which are respectively geared in use with suitable members of training and elevation drives, are used to continuously monitor the training and elevation angles of the gun, producing outputs at 3 and 4 respectively. Gearing is such that a training drive encoder electrical output goes through up to one complete cycle when the gun moves through the full training arc, and an elevation drive encoder electrical output goes through up to one complete cycle when the gun moves through its maximum elevation arc. Encoders with single-turn or multi-turn input shafts may be used. The output at 3 from the training drive encoder 1 is fed to a memory 5. Any suitable memory hardware may be used, but in this example a programmable read-only memory (PROM) constructed of semiconductors is used.

In such a PROM, the information is stored as a series of binary bits. Any number of binary bits may be used but in this example eight bits, giving $2^8=256$ binary numbers, are used. Thus, the training angles of the gun are specified by a first set of 256 binary numbers and similarly the elevation angles of the gun are specified by a second set of 256 binary numbers. The training arc is from —180° to 180° corresponding in binary notation to form (00000000) to (11111111) so that each binary number covers an arc of 360° /256=1.4° approximately, Similarly, the elevation arc is from −20° to +100°, corresponding to from (00000000) to (11111111) in binary notation so that each binary number covers an arc of 120° /256=0.5° approximately. Each one of the first set of 256 binary numbers, which defines training angles of the gun, addresses a "cell" in the memory 5 in which a minimum "safe to fire" angle of elevation is stored in binary notation. If the data in the memory 5 is set out as a bar chart in the form of 256 adjacent ordinates with the height of each ordinate denoting a minimum safe to fire angle of elevation, a curve such as shown in FIG. 2 would be obtained in which the ordinates, some of which are shown on the left-hand side as vertical strips greatly magnified in width, follow stepwise the smooth "desired safe to fire profile". The height of each particular ordinate corresponds to the nearest binary number equal to or above the maximum ordinate of the desired safe to fire profile at each of the 256 binary addresses. The stepwise safe to fire profile as shown in FIG. 2 does not follow the desired safe to fire profile very closely because wide vertical strips representing the ordinates at some of the binary addresses are shown for descriptive purposes. If narrower vertical strips were used, the stepwise profile would follow the ideal profile more closely.

As the gun is moved through its training arc, the training drive encoder 1 continuously monitors the actual training angle and feeds an eight bit binary output at 3 to the memory 5. Consider that the gun is pointing to starboard, causing the training drive encoder 1 to produce an output at 3 defined in binary notation as (a). The memory 5 is addressed by the binary number (a), as shown on the right-hand side of FIG. 2, and outputs the minimum safe to fire angle at the training angle defined by (a) as (c). This becomes an output at 6 from the memory 5 and is passed to a binary comparator 7. The elevation drive encoder 2 monitors the angle of elevation of the gun, producing an output at 4, defined in binary notation by (b), passing this output at 4 to the binary comparator 7. The binary comparator 7 compares the output at 6 from the memory 5, defined as (c), with the output at 4 from the elevation drive encoder 2, defined as (b). If (b) is greater than or equal to (c), the minimum safe to fire angle, then the binary comparator 7 will register a "safe to fire" decision output at 8. This process is shown diagrammatically on the right-hand side of FIG. 2. The angular position of the gun is specified by a cross at an elevation angle (b) and training angle (a) where the minimum safe to fire angle is (c) and as (b) is greater than (c) a safe to fire decision at 8 is registered. If, however, (b) was less than (c), i.e. the angular position of the gun was in the shaded "unsafe to fire" zone, then the binary comparator 7 would register an "unsafe to fire" decision output at 8.

It should be noted that as the curve in FIG. 2 is a "safe to fire" profile, it would be safe to fire if (b) is greater than or equal to (c). However, if the curve in FIG. 2 represents the limits of the "unsafe to fire" zone, it would be safe to fire only if (b) is greater than (c), i.e. when (b)=(c) it would not be safe to fire.

It is essential in the apparatus that a failure of any one component does not result in an incorrect safe to fire signal being transmitted to the gun. One means of overcoming such a failure is to duplicate the circuitry shown in FIG. 1. Referring to FIG. 3, two encoders 11, 21 monitor to training angle and a further two encoders 12, 22 monitor the elevation angle of the gun. The use of two encoders to monitor one reading creates a problem as a rotation of up to approximately 1.4° of the training arc, or approximately 0.5° of the elevation arc, could cause only one encoder of a pair to move from one binary number to the next. Manufacturing and/or installation tolerances would make it most unlikely that each pair of encoders always gives identical readings, though the difference between these readings should not be more than one binary interval. Consequently, a comparator 30 is used to check whether the encoder readings for both training angles agree exactly and whether the encoder readings for both elevation angles agree exactly and, if not, correction circuits 31, 32 are used to add one binary interval to the smaller reading (an alternative method being to subtract one binary unit from the larger reading, as required) so that the readings from both training encoders to agree and both elevation encoders do agree. In the special case where one encoder output is 255 (11111111) and the other encoder output is 0 (00000000), the correction circuits 31 and 32 add one binary interval to the higher number 255 (11111111). The readings (corrected if necessary) from the two training encoders 11, 21 are fed to respective memories 15, 25 and the minimum "safe to fire" outputs from these memories 15, 25 compared with the elevation readings (corrected if necessary) from the respective elevation encoders 12, 22 using respectively comparators 17, 27 to produce respectively two output signals at 18 and 28. If the output signal at 28 registers a "safe to fire" decision, this signal will pass via a connection 37 to cause "safe to fire" drivers 35 to close-circuit firing lines 36 thus allowing the gun to be fired when required. If the output signal at 28 is "unsafe to fire", the safe to fire drivers 35 will not be closed. However, a fault tolerant monitor 33 simultaneously checks whether the two output signals at 18 and 28 agree or not. If the output signals at 18 and 28 do agree then no action is taken, but if the output signals disagree, i.e. one registers "safe to fire" and the other "unsafe to fire", then the fault tolerant monitor 33 will cause fault inhibiting drivers 34 to interrupt the firing lines 36 thus stopping the gun from being fired. The system shown in FIG. 3 may thus be considered as a primary circuit, acting on inputs from the encoders 21 and 22 and when it is safe to fire passing a safe to fire signal at 28 to the safe to fire drivers 35, and a secondary circuit acting on inputs from encoders 11 and 12 to confirm the safe to fire signal from the primary circuit. If the secondary circuit does not confirm the safe to fire signal at 28, the fault inhibiting drivers 34 will break, the firing lines 36. The duplicated circuitry shown in FIG. 3 will prevent a single component failure from causing an incorrect "safe to fire" decision, e.g. if an electronic or electrical failure occurred in one half of the duplicated circuitry shown in FIG. 3, the fault tolerant monitor 33 would detect the difference in the output signals at 18 and 28 and open the fault inhibiting drivers 34 so making the apparatus "fail safe". To increase apparatus availability, the circuitry shown in FIG. 1 can be triplicated and the fault tolerant monitor and safe to fire driver circuits designed to act on two out of three "safe to fire" signals. Similarly, more complex fault tolerant apparatus can be designed to allow for a greater number of faults, but the cost and complexity of such apparatus must be chosen against the degree of availability required.

The duplicated circuitry shown in FIG. 3 can be improved by incorporating a checking system as shown in FIG. 4. The basic arrangement shown in FIG. 3 is reproduced in FIG. 4 as follows.

Two training encoders 111, 121 feed data via a comparator 130 and respective correction units 131, 132 to respective memories 115, 125. The outputs from these memories 115, 125 are respectively compared in comparators 117, 127 with the data passed via the comparator 130 and the respective correction units 131, 132 from the respective elevation encoders 112, 122. If the output signal at 128 registers a safe to fire decision, the output signal at 128 will pass via a connection 137 to cause safe to fire drivers 135 to close thus completing firing lines 136. An unsafe to fire decision output signal at 128 will not close the safe to fire drivers 135. The two output signals at 118 and 128 are passed to a fault tolerant monitor 133 to confirm any safe to fire decision in the output signal at 128. Any disagreement between output the signals at 118 and 128 will cause fault inhibiting drivers 134 to open-circuit the firing lines 136.

A checking system can be incorporated into the circuitry by placing four selectors 42, 43, 44 and 45 in the output lines from the four encoders 111, 112, 121 and 122 respectively. The selectors 42, 43, 44 and 45 are controlled by a channel selector 41 which is used to disconnect the encoders 111, 112, 121 and 122 in favour of an input to each of the four selectors from a binary counter 40 (or similar device). The binary counter 40 generates in a few seconds all of the 256 eight bit binary numbers representing the elevation arc for each of the 256 positions on the training arc, i.e. a total of 256×256 binary numbers, thus producing the same output that would have been generated by the four encoders if the gun was moved through its full 120°elevation arc at every binary interval in the full 360° training arc. Thus it is possible to quickly simulate the total range of training and elevation drive encoder outputs, and to detect for a failure in the duplicated circuits by using the fault tolerant monitor to detect for differing decisions of safe to fire/not safe to fire of signals at 118 and 128. Such a confidence check can be accomplished in a few seconds. The correct functioning of the fault tolerant monitor 133 using the checking system just described may be confirmed by deliberately introducing a fault through a fault injection circuit 46.

An angular position display can be incorporated into the circuitry of FIG. 4 as shown in FIG. 5 in which, for convenience, only part of the FIG. 4 circuitry has been shown. The binary code from any single one of encoders 111, 112, 121 and 122 is selected using a selector 201 and is input to a decoder 202. The decoder 202 converts the binary code into degrees and minutes, which is output to a digital display 203. Thus it is possible to check manually for correlation between individual training and individual elevation encoders. A test code from a device 200 is also selectable providing a check on the correct operation of the decoding circuitry.

In the above examples, reference has been made only to a single gun but it is equally possible that two or more guns would be mounted in a turret or a plurality of missiles be mounted on a launcher. Safety firing apparatus such as described above could be ideally suited to such installations, the memory or memories storing separate "safe to fire" profiles for each individual gun or missile thus enabling each gun or missile to be fired over its maximum individual "safe to fire" arcs rather than over a reduced "safe to fire" arc defined for the turret or missile launcher as a whole. Further, where more than one type of projectile etc. is to be fired from say a barrel, requiring therefore differing safety firing arc profiles, it is possible to store these separate individual safety firing arc profiles in the memory or memories, and to select as appropriate.

The use of an electronic memory or memories permits rapid changes to be made in the "safe to fire" profile or profiles stored therein. This could be done either by installing a new memory or memories and programming it or them with new data, or by erasing the existing memory or memories or portions thereof and reprogramming with new data. Such changes could be accomplished without disturbing the mechanical alignment of the safety firing apparatus.

We claim:

1. Safety apparatus for firing equipment which has a trainable and elevatable projectile guide, the safety apparatus comprising:

first and second angular position transducers for defining training and elevation angles of the projectile guide of the firing equipment and for generating first and second binary numbers in accordance therewith;

an electrically readable memory for storing a set of values which indicate directions of firing which are safe with respect to mounting location the equipment;

a comparator means for, in use of the apparatus, addressing said memory with said first binary number derived from one of said first and second transducers and for comparing said second binary number derived from the other of said first and second transducers with a third binary number stored in the memory at the address corresponding to the first binary number so as to effect a determination of whether or not it is safe to fire at the particular training angle and the particular elevation angle of the projectile guide;

at least one further of pair transducers, at least one further electrically readable memory, and at least one further comparator means for effecting at least one further determination, simultaneously with the first-mentioned determination, as to whether or not it is safe to fire; and fault checking circuit means for verifying the correct operation of the apparatus and for, responsive to the said comparator means, preventing firing of the equipment unless at least the first mentioned comparator means and said further comparator means both effect a determination that it is safe to fire, said apparatus further comprising a subsidiary comparator circuit associated with the transducers, and correction circuits for ensuring that the binary numbers derived from each of the transducers for defining the training angle are the same and for ensuring that the binary numbers derived from each of the transducers for defining the elevation angle are the same.

2. Safety apparatus as claimed in claim 1, wherein the electrically readable memories are interchangeable for other electrically readable memories.

* * * * *